US008829809B2

(12) United States Patent
Barnett et al.

(10) Patent No.: US 8,829,809 B2
(45) Date of Patent: Sep. 9, 2014

(54) WIRELESS SCENE ARRANGEMENT

(75) Inventors: Thomas Alan Barnett, Ypsilanti, MI (US); John Gerard Finch, Livonia, MI (US); Jeffrey Iott, Monroe, MI (US); Jian Xu, Windsor, CA (US)

(73) Assignee: EnOcean GmbH, Oberhacing (DE)

( * ) Notice: Subject to any disclaimer, the term of this patent is extended or adjusted under 35 U.S.C. 154(b) by 226 days.

(21) Appl. No.: 12/667,959

(22) PCT Filed: Jul. 25, 2008

(86) PCT No.: PCT/US2008/071124

§ 371 (c)(1),
(2), (4) Date: Jan. 6, 2010

(87) PCT Pub. No.: WO2009/020776

PCT Pub. Date: Feb. 12, 2009

(65) Prior Publication Data

US 2011/0012532 A1 Jan. 20, 2011

Related U.S. Application Data

(60) Provisional application No. 60/954,007, filed on Aug. 5, 2007, provisional application No. 61/033,838, filed on Mar. 5, 2008.

(51) Int. Cl.
*H05B 37/02* (2006.01)

(52) U.S. Cl.
CPC ..... *H05B 37/0272* (2013.01)
USPC ..... 315/294; 315/307; 315/312

(58) Field of Classification Search
USPC ..... 315/291, 294, 307, 312
See application file for complete search history.

(56) References Cited

U.S. PATENT DOCUMENTS

| | | | | |
|---|---|---|---|---|
| 3,827,038 | A | 7/1974 | Willis | |
| 3,860,872 | A * | 1/1975 | Richardson et al. | 455/135 |
| 4,365,238 | A | 12/1982 | Kollin | |
| 4,400,696 | A | 8/1983 | Klingensmith | |
| 5,146,153 | A * | 9/1992 | Luchaco et al. | 323/324 |
| 5,191,265 | A | 3/1993 | D'Aleo et al. | |
| 5,237,264 | A * | 8/1993 | Moseley et al. | 323/324 |

(Continued)

FOREIGN PATENT DOCUMENTS

| | | |
|---|---|---|
| EP | 0656612 A1 | 6/1995 |
| JP | 64-005296 | 1/1989 |

(Continued)

OTHER PUBLICATIONS

Search Report and Written Opinion mailed on Dec. 5, 2008 for PCT/US2008/070699.

(Continued)

*Primary Examiner* — Tung X Le
(74) *Attorney, Agent, or Firm* — Foley & Lardner LLP; Edward A. Gordon

(57) ABSTRACT

An example control arrangement includes a power supply, a first load operative to receive power when coupled to the power supply, and a second load operative to receive power when coupled to the power supply. A receiver is programmable to couple the first load, the second load, or both to the power supply in response to a wireless signal. A switch includes a wireless transmitter portion powered by a self-energizing portion. A wireless transmitter portion communicates the wireless signal to the receiver in response to an actuation of the switch.

19 Claims, 3 Drawing Sheets

(56) References Cited

U.S. PATENT DOCUMENTS

| | | | | |
|---|---|---|---|---|
| 5,455,464 | A * | 10/1995 | Gosling | 307/31 |
| 5,572,190 | A | 11/1996 | Ross et al. | |
| 6,445,302 | B2 | 9/2002 | Vena | |
| 6,737,969 | B2 | 5/2004 | Carlson et al. | |
| 6,775,523 | B2 | 8/2004 | Bentley | |
| 6,778,086 | B2 | 8/2004 | Morrone et al. | |
| 6,828,909 | B2 | 12/2004 | Script et al. | |
| 6,952,165 | B2 | 10/2005 | Kovach et al. | |
| 7,005,778 | B2 | 2/2006 | Pistor | |
| 7,019,241 | B2 | 3/2006 | Grassl et al. | |
| 7,085,534 | B2 | 8/2006 | Bentley | |
| 7,170,407 | B2 | 1/2007 | Wagner | |
| 7,389,674 | B2 | 6/2008 | Bulst et al. | |
| 7,498,952 | B2 * | 3/2009 | Newman, Jr. | 340/815.45 |
| 7,656,308 | B2 * | 2/2010 | Atkins | 340/12.3 |
| 8,588,103 | B2 * | 11/2013 | Barum | 370/254 |
| 2003/0016089 | A1 | 1/2003 | Cousy et al. | |
| 2003/0045239 | A1 | 3/2003 | Buckingham et al. | |
| 2003/0193417 | A1 | 10/2003 | Face et al. | |
| 2003/0198938 | A1 * | 10/2003 | Murray et al. | 434/429 |
| 2003/0206103 | A1 | 11/2003 | Morrone et al. | |
| 2004/0124741 | A1 | 7/2004 | Morrison et al. | |
| 2005/0024207 | A1 | 2/2005 | Schebel et al. | |
| 2005/0073405 | A1 | 4/2005 | Spoltore et al. | |
| 2005/0095984 | A1 | 5/2005 | Buckingham et al. | |
| 2005/0253486 | A1 | 11/2005 | Schmidt | |
| 2006/0012317 | A1 * | 1/2006 | Chiu et al. | 315/294 |
| 2006/0033597 | A1 | 2/2006 | Wells | |
| 2008/0018435 | A1 | 1/2008 | Brown | |

FOREIGN PATENT DOCUMENTS

| | | | |
|---|---|---|---|
| JP | 04-046495 | | 2/1992 |
| JP | 2001-224078 | | 8/2001 |
| JP | 2002-142269 | | 5/2002 |
| WO | WO03005388 | A2 | 1/2003 |
| WO | WO2006111934 | A1 | 10/2006 |
| WO | WO2007072325 | A2 | 6/2007 |

OTHER PUBLICATIONS

Search Report and Written Opinion mailed on Oct. 27, 2008 for PCT/US2008/070720.

Notification of Transmittal of the International Preliminary Report on Patentability mailed on Nov. 16, 2009 for PCT/US2008/070720.

Search Report and Written Opinion mailed on Jan. 22, 2009 for PCT/US2008/071120.

Notification of Transmittal of the International Preliminary Report on Patentability mailed on Nov. 11, 2009 for PCT/US2008/071120.

Search Report and Written Opinion mailed on Oct. 27, 2008 for PCT/US2008/070700.

Notification of Transmittal of the International Preliminary Report on Patentability mailed on Nov. 16, 2009 for PCT/US2008/070700.

Search Report and Written Opinion mailed on Jan. 22, 2009 for PCT/US2008/071124.

Notification of Transmittal of The International Preliminary Report on Patentability mailed on Nov. 3, 2009 for PCT/US2008/071124.

PCT Patent Application "Wireless Switching Applications", Application No. PCT/US2008/070699 filed on Jul. 22, 2008.

PCT Patent Application "Security System Including Wireless Self-Energizing Switch", Application No. PCT/US2008/070720 filed on Jul. 22, 2008.

PCT Patent Application "Notification System Utilizing Self-Energizing Switches", Application No. PCT/US2008/071120 filed on Jul. 25, 2008.

PCT Patent Application "Door Notification System", Application No. PCT/US2008/70700 filed on Jul. 22, 2008.

http:/www.castlewholesalers.com/HEATH-ZENITH-SL-6162-Wireless-F-B-Door-Chime-Off-White.html.

* cited by examiner

WIRELESS SCENE ARRANGEMENT

CROSS-REFERENCE TO RELATED APPLICATIONS

This application is a U.S. National Stage of International Application Number PCT/US2008/071124, filed Jul. 25, 2008, which claims priority to U.S. Provisional Application Ser. No. 60/954,007 filed on 5 Aug. 2007 and to U.S. Provisional Application Ser. No. 61/033,838 filed on 5 Mar. 2008, all of which are incorporated herein by reference.

BACKGROUND

This application relates to controlling a scene utilizing self-energizing switches.

Switches that transmit wireless communications are known. For example, some switches transmit wireless communications to garage door openers. Many switches utilize a replaceable internal power source, such as a battery, to power the wireless communication transmissions. Servicing these internal power sources can be inconvenient and costly. For example, accessing a battery within a wall-mounted light switch is often difficult and time-consuming. Rather than replaceable internal power sources, some switches harvest energy to power the wireless communications from the switch.

Some buildings include complex control systems for lighting, audio equipment, etc. Prior control systems include wired and battery based switches, both of which are often expensive and inflexible.

SUMMARY

An example lighting control arrangement includes a power supply, a first load operative to receive power when coupled to the power supply, and a second load operative to receive power when coupled to the power supply. A receiver is programmable to couple the first load, the second load, or both to the power supply in response to a wireless signal. A switch includes a wireless transmitter portion powered by a self-energizing portion. A wireless transmitter portion communicates the wireless signal to the receiver in response to an actuation of the switch.

Another example lighting control arrangement includes a power supply, a first light operative to illuminate when coupled to the power supply, and a second light operative to illuminate when coupled to the power supply. A programmable controller is configured to store at least one scene. A receiver is operative to couple the first light, the second light, or both to the power supply in response to a wireless signal and based on the scene. A switch has a wireless transmitter portion powered by a self-energizing portion. The wireless transmitter portion communicates the wireless signal to the receiver in response to an actuation of the switch.

An example method for use with the wireless security system includes programming a controller to store at least one light scene and communicating a wireless signal using power provided by a self-energizing portion of a switch. The method includes initiating one of the scenes in response to the communicated wireless signal.

These and other features of the present invention can be best understood from the following specification and drawings, the following of which is a brief description.

DETAILED DESCRIPTION

Figure 1:
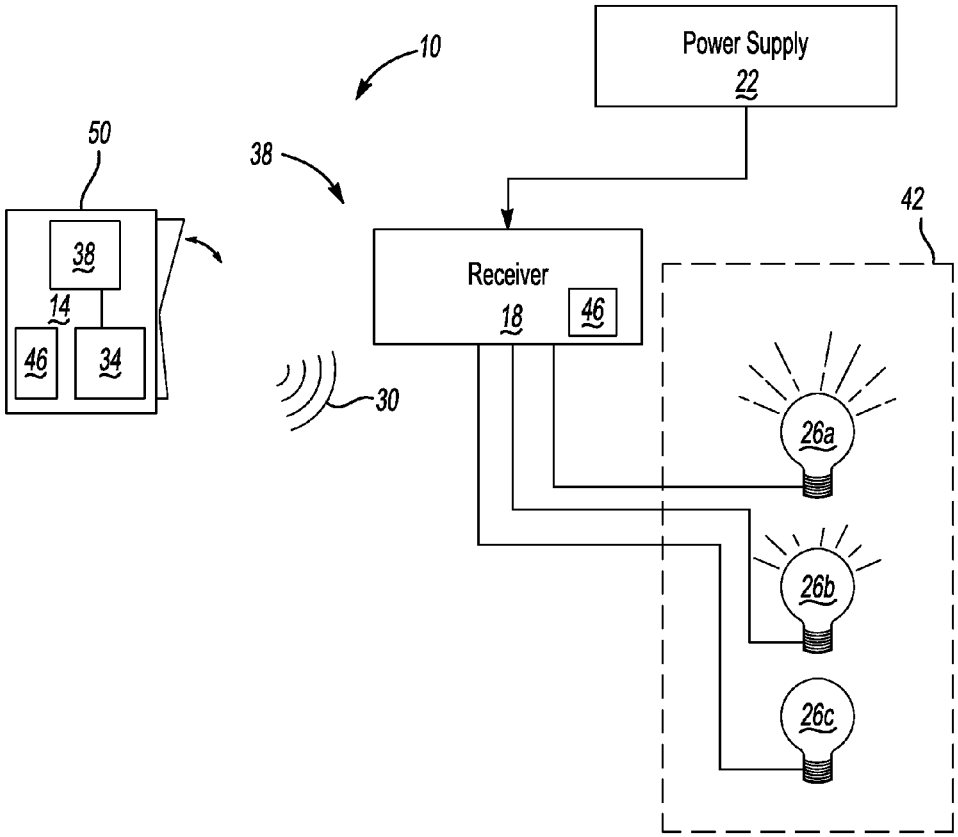
FIG. 1 schematically illustrates an example lighting control arrangement.

Referring to FIG. 1, an example control arrangement 10 includes a switch 14 in wireless communication with a receiver 18. A power supply 22 is operative to provide power to a first light 26*a*, a second light 26*b*, and a third light 26*c*. The receiver 18 selectively couples the power supply 22 to one or more of the lights 26*a*-26*c* in response to a wireless communication 30 from the switch 14.

In this example, the switch 14 is self-energizing and includes a wireless transmitter portion 34 and a self-energizing portion 38. The self-energizing portion 38 provides power to the wireless transmitter portion 34, which transmits the wireless communication 30. One example switch 14 suitable for transmitting the wireless communication 30 is available from EnOcean under Product No. PTM250.

The example switch 14 is a rocker type switch and is actuated by rocking portions of the switch 14 within a switch housing 50. Other example switch actuations include motion sensors indicating the presence of a user's hand, for example, or push button type switches. In one example, the actuation of portions of the switch 14 energizes the self-energizing portions 38 of the switch 14. In other examples, the self-energizing portion 38 energizes through photovoltaic cells, piezoelectric devices, etc. The example switch 14 thus does not rely on an internal power supply to power the wireless communication 30, but instead harvests energy to power the wireless communication 30.

Although the receiver 18 is shown as a multi-channel receiver, it should be understood that the receiver 18 could also be a single channel receiver. Other examples include the receiver 18 coupled different numbers of the lights 26*a*-26*c*.

Other examples of the control arrangement 10 utilize more than one of the receiver 18. One example receiver 18 suitable for use within the control arrangement 10 is available from EnOcean under Product No. RCM130C. Although the location of the receiver 18 is fixed in this example, other example receivers are portable. For example, other examples of the receiver 18 include a USB portion and are operative to receive the wireless communication 30 once the USB portion is linked to a computer (not shown). Such examples facilitate moving the receiver 18 to receive the wireless communication 30 in a multiple of areas.

The example receiver 18 includes a programmable controller 46 that controls the illumination levels of the lights 26*a*-26*c* by controlling the coupling between the power supply 22 and each of the lights 26*a*-26*c*, the power level supplied to the lights 26*a*-26*c* from the power supply 22, or both. A person skilled in the art having the benefit of this disclosure would be able to develop a controller suitable for providing such control over the illumination of the lights 26*a*-26*c*. Example programmable controllers 46, which may also reside in switch housing 50, include a microprocessor, a lap top computer, etc.

The first light 26*a*, the second light 26*b*, and the third light 26*c* provide a scene 42, which is a lighting scene in this example. In this example of the scene 42, the first light 26*a* is more illuminated than both the second light 26*b* and the third light 26*c*, and the second light 26*b* is more illuminated than the third light 26*c*. Also in this example, the third light 26*c* is off. That is, the third light 26*c* provides no illumination in this example scene 42. Other examples of the scene 42 incorporate a piece of audiovisual equipment, such as a stereo, or a computer.

Figure 2A:
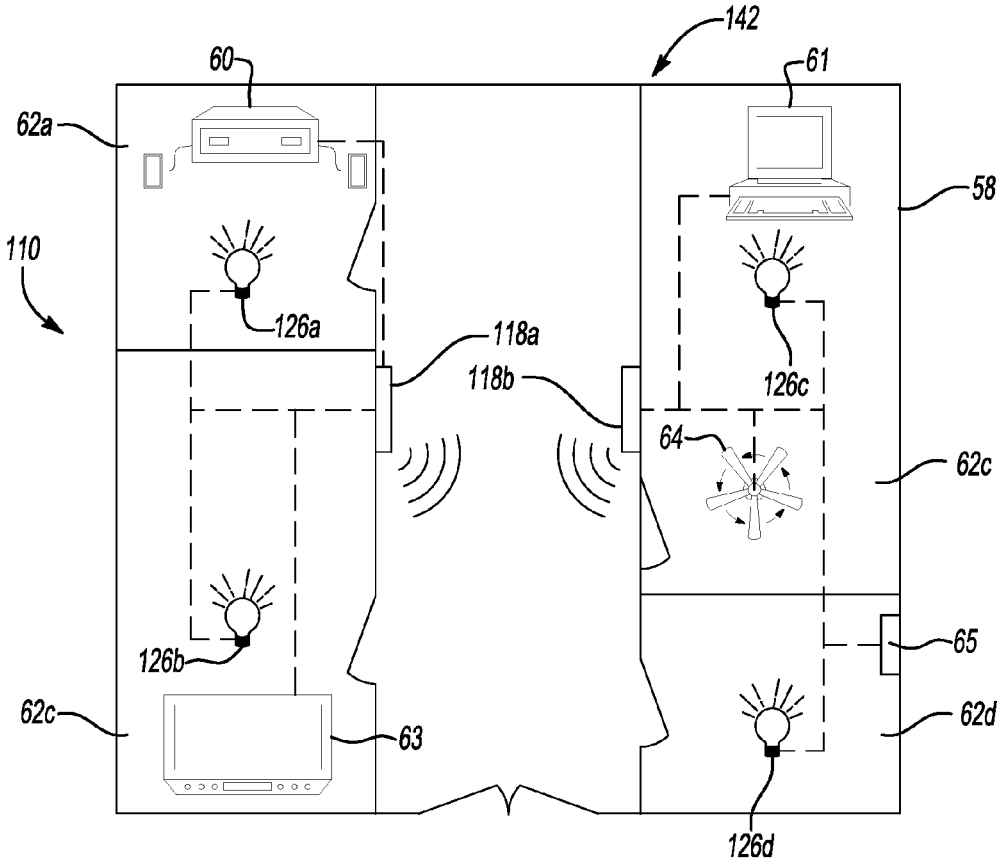
FIG. 2A shows an example receiver portion of the FIG. 1 arrangement implemented within an example building.
Figure 2B:
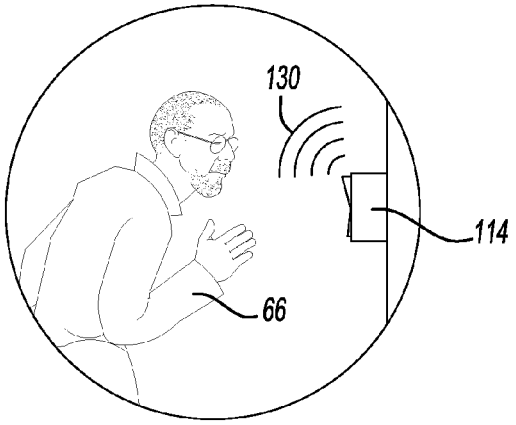
FIG. 2B shows an example switch portion for controlling the FIG. 2A receiver portion.

Referring now to FIG. 2 with continuing reference to FIG. 1, an example control arrangement 110 that is somewhat similar to the control arrangement 10 described in the FIG. 1 example is implemented within a building 58. In this disclosure, like reference numerals designate like elements where appropriate and reference numerals with the addition of 100 or multiples thereof designate modified elements. The modified elements incorporate the same basic features and benefits of the corresponding modified elements, except where stated otherwise.

In this example, the control arrangement 110 includes four lights 126*a*-126*d* and two receivers 118*a* and 118*b*. A user 66 actuates a switch 114, which then communicates a wireless signal 130 to both the receiver 118*a* and the receiver 118*b*. The receivers 118*a*, 118*b* are programmed such that, upon receipt of the wireless signal 130, the receivers 118*a*, 118*b* couple the light 126*a* and the light 126*d* to a power supply (not shown). The building includes a plurality of rooms 62*a*-62*d*. Powering the light 126*a* illuminates the room 62*a* and powering the light 126*d* illuminates the room 62*d*. Thus, in this example, the scene 142 for the building 58 illuminates the rooms 62*a* and 62*d*, not rooms 62*b* and 62*c*. Other examples include using the control arrangement 110 to control power distribution to a stereo 60 within the room 62*a*, which is a portion of the scene 142. Still other examples include providing power to a computer 61, a television 63 a ceiling fan 64, or a power receptacle 65.

Figures 3A, 3B:
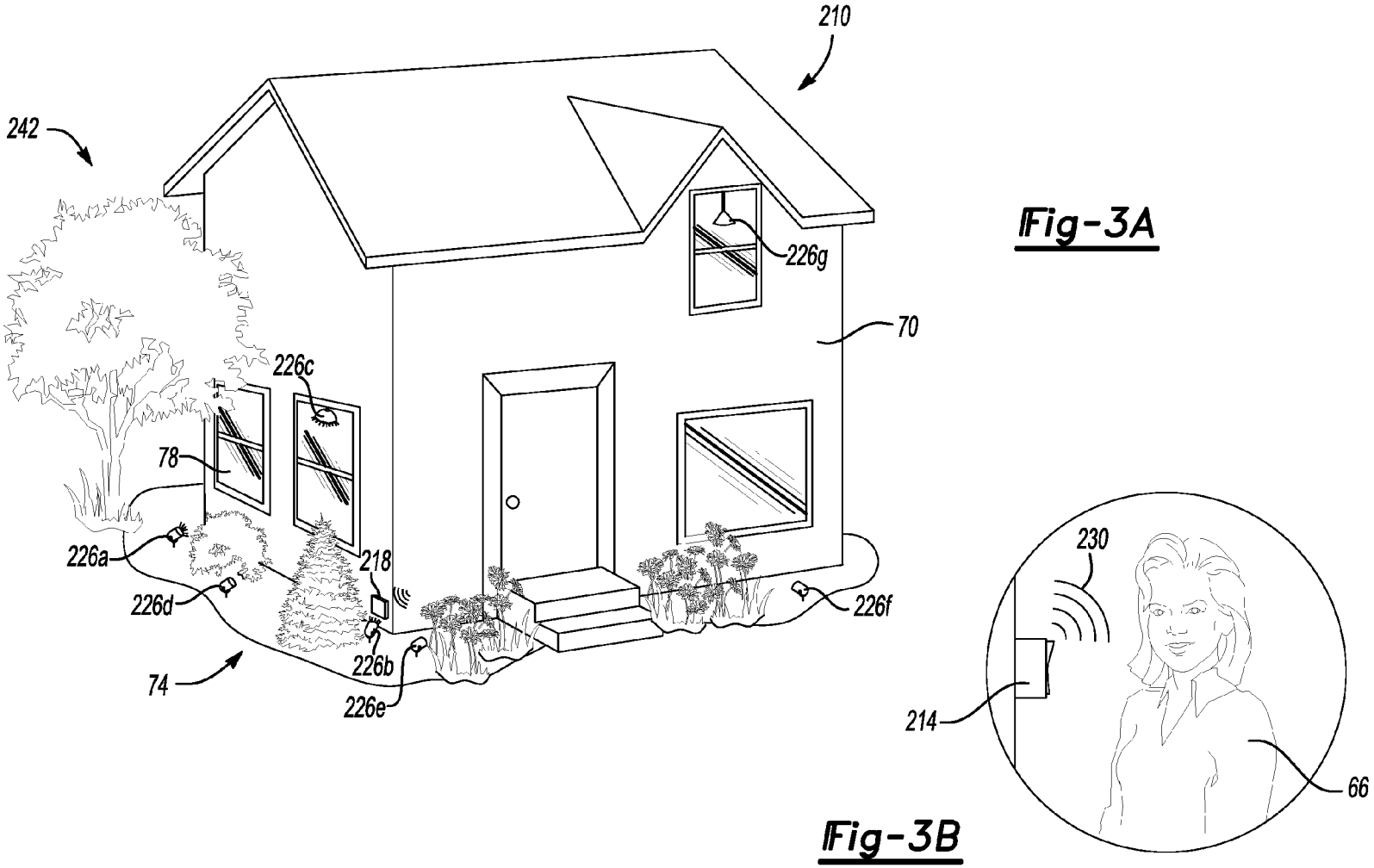
FIG. 3A shows another example receiver portion of the FIG. 1 arrangement implemented within another example building.
FIG. 3B shows an example switch portion of FIG. 1 for controlling the FIG. 3A receiver portion.

Referring now to FIG. 3 with continuing reference to FIG. 1, the user 66 actuates a switch 214 to communicate a wireless signal 230 to the receiver 218, which is mounted on the exterior of a home 70. The receiver 218, through wired connections (not shown), is programmed to illuminate initiate a scene 242 in response to the wireless signal 230. In this example, the lighting scene 242 comprises illuminating a first plurality of lights 226*a*-226*c*, but not a second plurality of lights 226*d*-226*g*. In this example, the lights 126*a*, 126*b* illuminate an exterior area 74, and the light 126*c* illuminates an interior area 78 of the home 70. In so doing, the user 66 is able to remotely initiate a lighting scene 242 associated with the home 70 using the switch 214.

Features of this disclosure include utilizing self-energizing switches to control a particular lighting scene, which can be changed by programming a controller. Another feature of this disclosure is that the switch is movable relative to the receiver and does not require a wired connection to power wireless communications from the switch.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. A control arrangement comprising:

a power supply;

a first load operative to receive power when coupled to the power supply;

a second load operative to receive power when coupled to the power supply;

a receiver programmable to couple the first load, the second load, or both to the power supply in response to a wireless signal; and a switch including:

a self-energizing portion, including an electromechanical energy transducer; and a wireless transmitter portion powered by the self-energizing portion, wherein the wireless transmitter portion communicates the wireless signal to the receiver in response to an actuation of the switch, wherein the electromechanical energy transducer harvests energy from the actuation of the switch by converting mechanical energy applied to actuate the switch to electrical energy.

2. The control arrangement of claim 1, including a second receiver programmable to selectively couple at least one third load to the power supply in response to the wireless signal.

3. The control arrangement of claim 1, wherein the first load and the second load are a first light and a second light, and the receiver is programmable to couple the first load and the second load to the power supply such that the first load provides more or less illumination than the second load.

4. The control arrangement of claim 1, wherein the first load and the second load are operative to illuminate at least one interior space.

5. The control arrangement of claim 1, wherein the switch is moveable between an interior space and an exterior space.

6. The control arrangement of claim 1, wherein the receiver is programmable to store more than one scene wherein each scene provides a desired illumination level for a first light and a desired illumination level for a light in response to the wireless signal.

7. The control arrangement of claim 1, wherein the first load comprises at least one of a television, a piece of audio equipment, and a computer.

8. A lighting control arrangement comprising:

a power supply;

a first light operative to illuminate when coupled to the power supply;

a second light operative to illuminate when coupled to the power supply;

a programmable controller configured to store more than one lighting scene;

a receiver operative to couple the first light, the second light, or both to the power supply in response to a wireless signal and based on the at least more than one lighting scene; and a switch having a wireless transmitter portion powered by a self-energizing portion, which includes a electromechanical energy transducer, wherein the wireless transmitter portion communicates the wireless signal to the receiver in response to an actuation of the switch, wherein the electromechanical energy transducer harvests energy from the actuation of the switch by converting mechanical energy applied to actuate the switch to electrical energy.

9. The lighting control arrangement of claim 8, wherein the switch comprises the programmable controller.

10. The lighting control arrangement of claim 8, wherein the receiver comprises the programmable controller.

11. The lighting control arrangement of claim 8, wherein the at more than one lighting scene comprises a desired illumination level for the first light, the second light, or both.

12. The lighting control arrangement of claim 8, wherein the first light is operative to illuminate an interior area and the second light is operative to illuminate an exterior area.

13. The control arrangement of claim 8, including a stereo operative to produce sound when coupled to the power supply.

14. A method for use with a wireless control system, comprising:

programming a memory portion to store at least more than one scene;

communicating a wireless signal using power provided by a self-energizing portion of a switch, which includes a electromechanical energy transducer, wherein the electromechanical energy transducer harvests energy from the actuation of the switch by converting mechanical energy applied to actuate the switch to electrical energy; and initiating one of the more than one scenes in response to the communicated wireless signal.

15. The method of claim 14, wherein the more than one scene comprises illuminating a first light, a second light, or both.

16. The method of claim 15, wherein the at least more than one scene comprises a desired level of illumination for the first light, the second light, or both.

17. The method of claim 14, including selectively electrically connecting a first light, a second light, or both with a power supply based on one of the more than one scene.

18. The method of claim 14, wherein the more than one scene couples a first light to a power supply, a second light to a power supply, or both the first light and the second light to the power supply in response to the communicated wireless signal, wherein the coupling depends on the more than one scene.

19. The method of claim 14, wherein the more than one scene initiates a receiver to couple a first light to a power supply, a second light to a power supply, or both the first light and the second light to the power supply in response to the communicated wireless signal, wherein the coupling depends on the more than one lighting scene.

* * * * *